United States Patent [19]

Jackson

[11] 4,329,976

[45] May 18, 1982

[54] STOVE WITH DRAFT AIR COOLING OF REAR, OPPOSITE SIDE AND FLUE PIPE

[76] Inventor: J. D. Jackson, 38751 Camp Creek Rd., Springfield, Oreg. 97477

[21] Appl. No.: 138,369

[22] Filed: Apr. 8, 1980

[51] Int. Cl.[3] ..... F23J 11/00; F24B 3/00; F24C 1/14

[52] U.S. Cl. ..... 126/312; 126/67; 126/77; 126/307 R

[58] Field of Search ..... 126/67, 121, 77, 312, 126/307 R, 307 A, 77

[56] References Cited

U.S. PATENT DOCUMENTS

| | | | |
|---|---|---|---|
| 189,054 | 4/1877 | Moore | 126/312 |
| 279,291 | 6/1883 | Waide | 126/312 |
| 656,895 | 8/1900 | King | 126/312 |
| 1,136,615 | 4/1915 | Rice | 126/77 |
| 1,655,858 | 1/1928 | Donovan | 126/312 |
| 3,219,024 | 11/1965 | Hottenroth et al. | 126/77 |
| 4,141,336 | 2/1979 | Fitch | 126/121 |
| 4,214,569 | 7/1980 | Heine | 126/67 |

*Primary Examiner*—Samuel Scott
*Assistant Examiner*—Wesley S. Ratliff, Jr.
*Attorney, Agent, or Firm*—Harvey B. Jacobson

[57] ABSTRACT

A heating stove including a pair of opposite side walls and front, rear and top and bottom walls interconnecting and extending between front, rear and top and bottom marginal portions of the side walls. A pair of inner side panels are provided and spaced inwardly of the side walls and extend between the top and bottom walls defining interior side wall hollow areas. A rear inner panel is spaced inward of the rear wall and extends between the rear marginal portions of the inner side panels defining an interior rear wall area. A firebox is defined between the side panels and the rear panel and front wall and includes a flue outlet opening outwardly from an upper rear portion of the firebox. Combustion air inlet structure is provided operative to admit combustion air into the lower portion of the interior rear wall area and the upper portion of the interior rear wall area and the rear upper portions of the interior side wall areas are communicated. The lower forward portions of the side panels include openings therethrough into the firebox. Combustion air is admitted into the lower portion of the interior rear wall area, passes upwardly therethrough and into the interior side wall areas and thereafter downwardly and forwardly through the latter and into the forward opposite side lower portions of the firebox. In this manner, the operating temperature of the exterior rear and opposite side walls are greatly reduced.

7 Claims, 6 Drawing Figures

STOVE WITH DRAFT AIR COOLING OF REAR, OPPOSITE SIDE AND FLUE PIPE

BACKGROUND OF THE INVENTION

Persons who live in mobile homes may experience considerable savings in heating bills by utilizing heating stoves within their mobile homes. However, mobile homes are reasonably compact and the normal spacing between the external heated surfaces of a stove or a similar heater and combustible products presents a problem insofar as available space in concerned. Accordingly, a need exists for a stove or heater which may be more closely spaced from surrounding combustible products and thus enable the stove or heater to be used in more closely confined areas.

Although numerous stoves and heaters heretofore have been designed including various internal and external passages through which heating air may be passed, such as the heaters and stoves disclosed in U.S. Pat. Nos. 7,127, 4,015,579, 4,027,659, 4,121,560 and 4,136,663, these previously known forms of stoves and heaters do not include structure whereby the rear and opposite side external surfaces thereof may be effectively maintained cool without the addition of expensive exterior insulative panels thereto.

BRIEF DESCRIPTION OF THE INVENTION

The stove or heater of the instant invention is constructed in a manner whereby combustion air is initially passed through hollow compartments immediately inwardly of the rear and opposite side walls of the stove or heater before being admitted into the lower forward opposite side portions of the firebox for support of combustion of fuel therein. In addition, the flue outlet of the stove is constructed in a manner whereby at least the initial exterior rear surfaces thereof are also maintained cooled by the admission of fresh air into the flue outlet by venturi action.

The main object of this invention is to provide an improved heater or stove for burning solid fuels therein and constructed in a manner whereby the exterior surfaces of the rear and opposite side walls of the stove will be maintained considerably cooler than those temperatures which are normally associated with area heating stoves or heaters.

Another object of this invention is to provide an area heater or stoves including a flue outlet which may also be maintained in a cooled state, at least throughout the portions thereof facing away from the heater.

Still another important object of this invention is to provide a space heater or stove in accordance with the preceding objects and which is constructed in a manner enabling the burning of various solid fuels therein.

A further object of this invention is to provide a heating stove in accordance with the preceding objects and including openable door structure in its front wall over which a spark arresting screen may be placed.

Yet another important object of this invention is to provide a heating stove including an upper surface portion thereof which may be utilized for cooking purposes.

A final object of this invention to be specifically enumerated herein is to provide a heating stove in accordance with the preceding objects and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
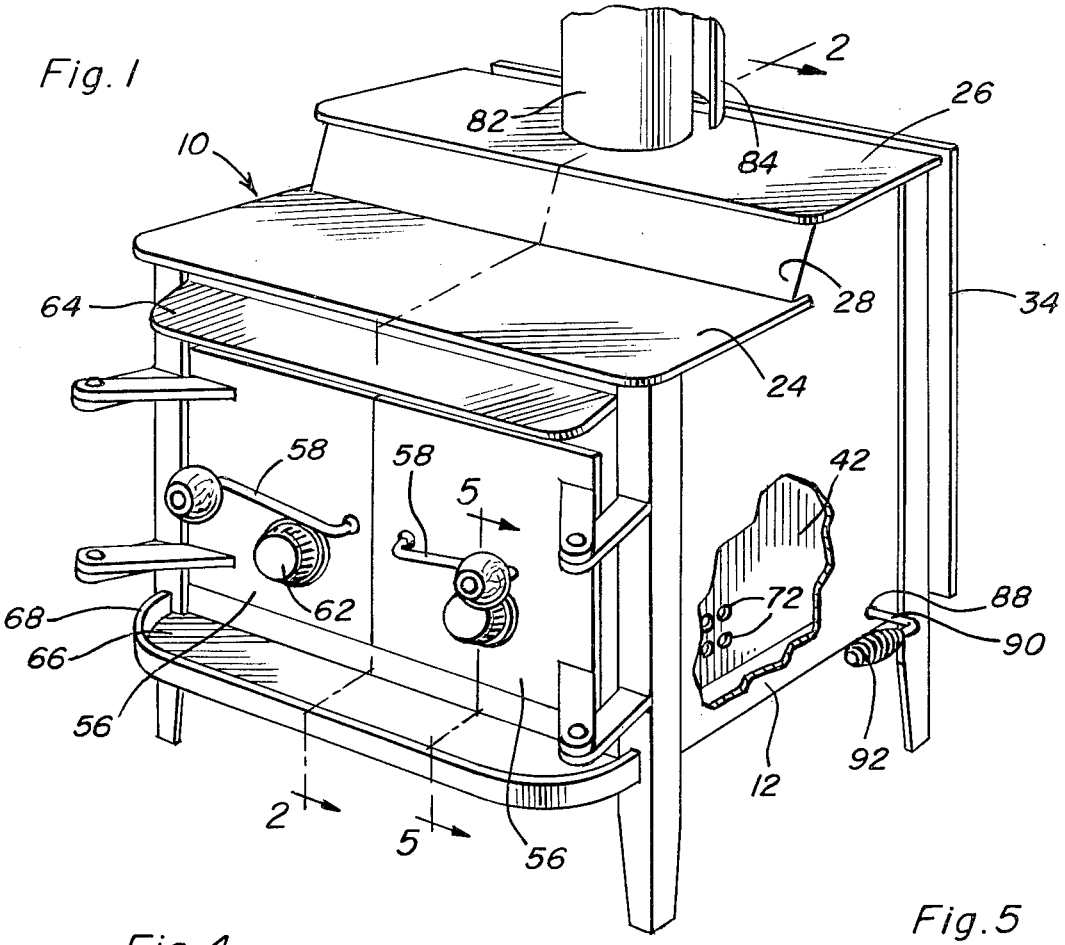
FIG. 1 is a perspective view of the heating stove of the instant invention.
Figure 4:
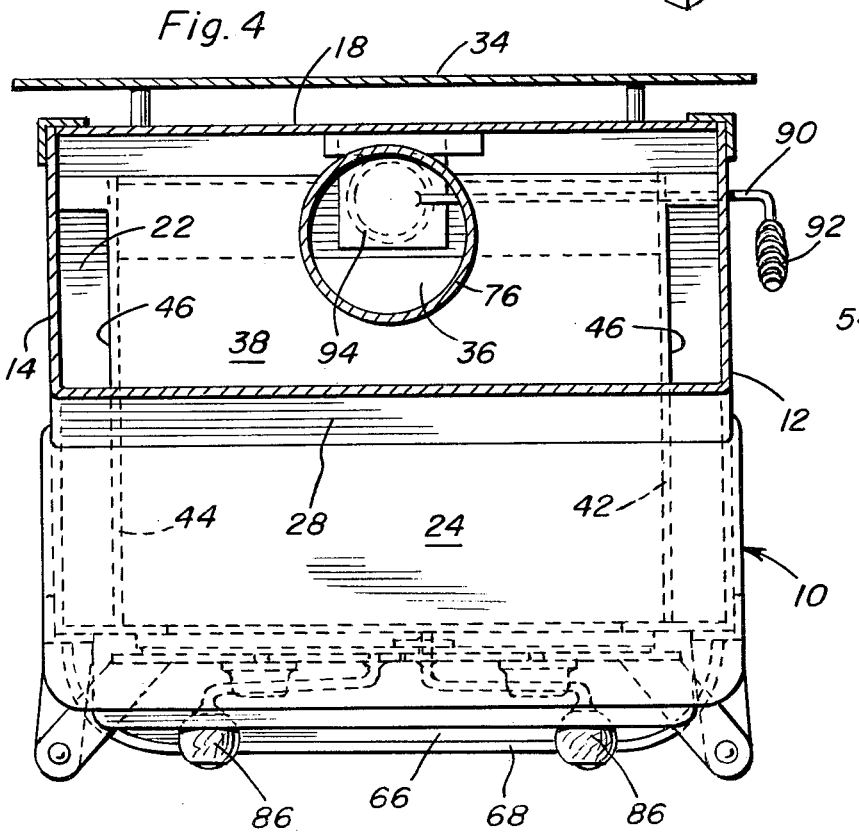
FIG. 4 is a horizontal sectional view taken substantially upon the plane indicated by the section line 4—4 of FIG. 3.
Figure 5:
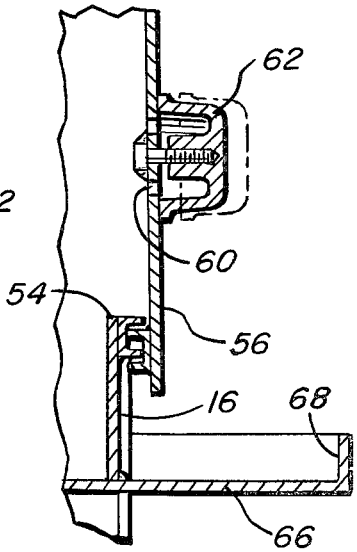
FIG. 5 is a fragmentary enlarged vertical sectional view taken substantially upon the plane indicated by the section line 5—5 of FIG. 1.
Figure 6:
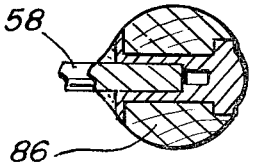
FIG. 6 is an enlarged sectional view illustrating the internal structure of one of the door handle hand grips of the stove.
Figure 3:
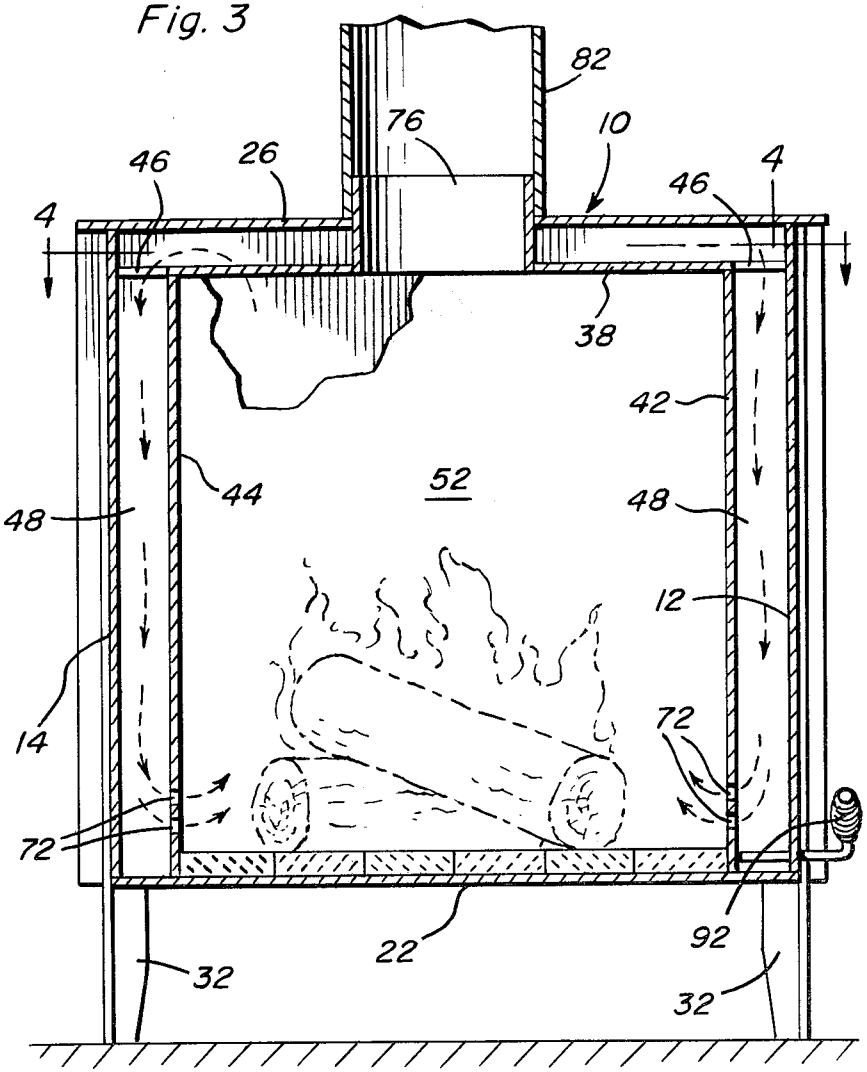
FIG. 3 is a transverse vertical sectional view taken substantially upon the plane indicated by the section line 3—3 of FIG. 2.
Figure 2:
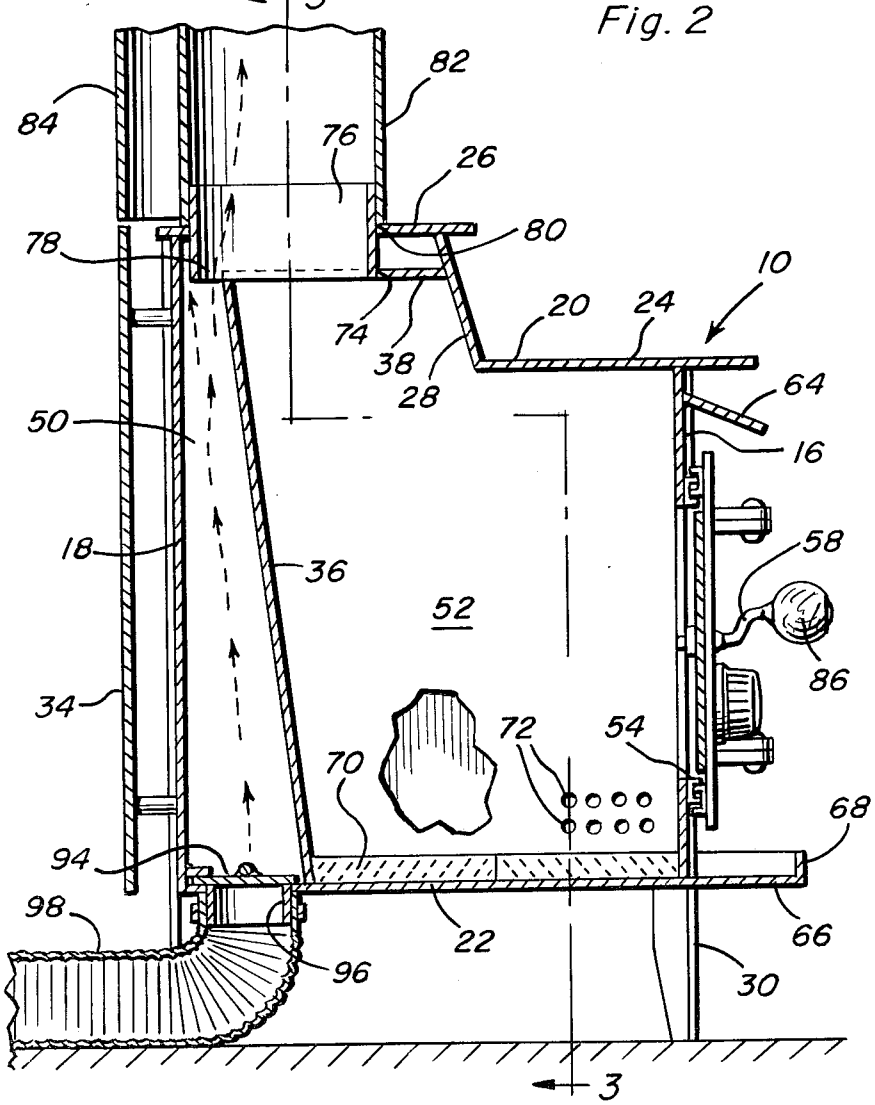
FIG. 2 is an enlarged fragmentary transverse vertical sectional view taken substantially upon the plane indicated by the section line 2—2 of FIG. 1.

Referring now more specifically to the drawings, the numeral 10 generally designates the heating stove of the instant invention.

The stove 10 includes a pair of exterior opposite side walls 12 and 14 and front and rear walls 16 and 18 extending between the front and rear marginal portions of the side walls 12 and 14. Also, the stove includes top and bottom walls 20 and 22 extending between the upper and lower marginal portions, respectively, of the opposite side walls 12 and 14 and front and rear walls 16 and 18.

The top wall 20 includes a lower forward portion 24 and a raised rear portion 26 as well as a rearwardly and upwardly inclined intermediate portion 28 extending between and connecting the rear marginal portion of the front top wall portion 24 and the forward marginal portion of the rear top portion 26.

The front and rear opposite side corners of the stove 10 include depending support legs 30 and 32 and a rear heat shield panel 34 is supported in spaced relation relative to and generally parallels the exterior surface of the rear wall 18.

The heater 10 includes a rear transverse inner panel 36 extending between the rear marginal portions of the side walls 12 and 14 and spaced forwardly of the rear wall 18. The lower marginal edge of the panel 36 is supported from the bottom wall 22 along a transverse zone thereof spaced forward of the lower marginal portion of the rear wall 18 and an inner horizontal top wall portion 38 extends between the upper marginal portions of the side walls 12 and 14 below the raised rear portion 26 of the top wall 20. The forward marginal edge of the inner top wall portion 38 is anchored relative to the upper marginal portional of the intermediate portion 28 of the top wall 20 and the rear marginal edge of the inner top wall portion 38 is anchored relative to the upper marginal portion of the panel 36.

Inner side panels 42 and 44 are spaced inwardly of the side walls 12 and 14 and extend between the opposite side marginal portions of the bottom wall 22 and the top wall 20. The forward upper marginal edges side panels 42 and 44 are anchored relative to the lower forward top wall portions 24, the rear upper marginal edges of the inner side panels 42 and 44 are anchored relative to the opposite side marginal portions of the inner top wall portion 38 and the intermediate upper marginal edge portions of the inner side panels 42 and 44 are anchored relative to the intermediate portion 28 of the top wall 20. The opposite side marginal edges of the inner top wall portion 38 include openings 46 formed therein whereby the rear upper portions of the inner hollow areas 48 of the side wall structures of the stove 10 are communicated with the upper marginal portion of the hollow area 50 of the rear wall structure of the heater 10.

A firebox area 52 is defined between the inner side panels 42 and 44 forward of the panel 36 and rearward of the front wall 16 and the latter includes an access opening 54 removably closable by hinged doors 56 equipped with handle structures 58 and supplemental combustion air inlet openings 60 which may be variably closed by damper caps 62 threadedly supported from the doors 56 and overlying the outer surfaces of the portions of the doors 56 in which the combustion air inlet openings 60 are formed.

An eyebrow flange 64 is supported and projects outwardly and downwardly from the upper marginal portion of the front wall 16 and a lower horizontally outwardly projecting ash and spark catching lip 66 comprising a forward extension of the bottom wall 22 extends forwardly from the lower marginal edge of the front wall 16 below the opening 54. The lip 66 includes a peripheral curb 68 extending thereabout and the lip serves to catch ashes and sparks which may move forwardly through the opening 64 when the doors 56 are open. Also, the lip 66 may be utilized to support a suitable fire screen in front of the opening 54 when the doors 56 are in their fully opened positions substantially paralleling and spaced slightly outwardly of the side walls 12 and 14 of the stove 10.

That portion of the bottom wall 22 which defines the lower extremity of the firebox area 52 is provided with firebricks 70 disposed thereover and the lower forward marginal portions of the side panels 42 and 44 have combustion air inlet openings 72 formed therein while the central rear portion of the inner top wall portion 38 has an outlet opening 74 formed therein in which the bottom of a flue outlet fitting 76 is secured. The flue outlet fitting 76, however, projects slightly rearwardly of the central portion of the upper marginal edge of the panel 36 and thus defines a venturi area 78 for a purpose to be hereinafter more fully set forth. The fitting 76 opens upwardly through an opening 80 formed in the raised rear top wall portion 26 and the lower end of a flue pipe 82 having a spaced shield 84 supported from the rear side thereof is downwardly telescoped over the upper end of the fitting 76 which projects above the raised rear portion 26 of the top wall 20.

The handle structures 58 include heat insulated hand grips 86 supported therefrom and the rear lower corner portion of the side wall 12 includes an aperture 88 formed therein through which the outer end of a damper control rod 90 projects. The outer end of the rod 90 terminates in a forwardly directed handle 92 and the inner end of the rod 90 is anchored relative to a damper plate 94 disposed at the bottom of the area 50 and overlying a downwardly opening combustion air inlet 96. The outlet end of a flexible combustion air inlet conduit 98 is removably clamped over the downwardly projecting combustion air inlet 96 and the inlet end of the conduit 98 may open to the exterior of the enclosure in which the stove 10 is disposed.

In operation, some combustion air, if desired, may be admitted into the firebox area 52 through the combustion air inlet openings 60 adjustably closable by the threadedly supported caps 62. However, a major portion of the combustion air is admitted into the firebox area 52 through the openings or apertures 72, the opposite side areas 48, the rear area 50 and the inlet fitting 96 and conduit 98. Of course, the amount of combustion air admitted into the area 50 from the conduit 98 may be adjustably varied by sliding the damper plate 94 into varied registry with the upper end of the fitting 96. In this manner, cool combustion air from the exterior of the enclosure in which the heater 10 is disposed may be admitted into the area 18 and thus cool not only the inner rear panel 36 but also the rear wall 18, the outer surface of the latter being shielded by the heat shield panel 34. Thereafter, the combustion air moves into the space between the rear raised portion 26 of the top wall 20 and the inner top wall portion or panel 38 and thereafter passes downwardly through the openings 46 and into the areas 48 between the side walls 12 and 14 and the inner side panels 42 and 44. Thereafter, the combustion air enters the firebox area 52 through the openings or apertures 72. Thus, the exterior surfaces of the inner side panels and the side walls 12 are also cooled by the movement of combustion air through the interior side wall areas 48 before passing through the openings or bores 72 into the firebox area 52. Because of the provision of the areas 48 and 50, the stove 10 may be more closely spaced relative to combustible materials within the enclosure in which the heater 10 is disposed. However, inasmuch as the combustion air, while cooling the side walls 12 and 14 and the rear wall 18, absorbs heat before passing into the firebox area 52, enables the fire within the firebox 52 to burn hotter and the heater radiating portions 24 and 28 of the top wall 20 and the front wall 16 and doors 56 radiate more heat to the interior of the enclosure in which the stove 10 is disposed thus resulting in little loss of total heat from the fire within the firebox 52.

As the combustion air from the firebox 52 moves upwardly through the flue outlet fitting 76, a venturi action is created at 78 whereby some of the combustion air admitted into the area 50 is drawn upwardly into the rear portion of the fitting 76 and thereafter into the rear portion of the lower end of the flue pipe 82. Thus, even the rear lower portion of the flue pipe 82 is cooled.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A room heater including a pair of opposite side walls and front, rear and top walls interconnecting and extending between front, rear and top and bottom marginal portions of said side walls, a pair of inner side panels spaced inwardly of said side walls and extending between said top and bottom walls, a rear inner panel spaced inward of said rear wall and extending between said side walls and having the rear marginal portions of said inner side panels secured thereto inwardly of said side walls, said side panels including air passage openings formed therethrough in the forward lower portions thereof, said heater defining a firebox therein between said side panels and between said rear panel and said front wall and including a flue outlet opening outwardly from an upper rear portion of said firebox, and combustion air inlet means operative to admit combustion air into the lower portion of the area between said rear wall and said rear panel, the front and rear portions of the areas between said side walls and the corresponding side panels being closed by said front and rear walls, respectively, said top wall including lower forward and upper rear portions interconnected by an upstanding intermediate portion extending between the front and rear marginal portions of said upper rear and lower forward portions, a generally horizontal inner top wall portion spaced below said upper rear portion rearward of said intermediate portion extending between said side walls and having front and rear marginal portions secured to said intermediate portion and the upper marginal portion of said rear panel, the upper rear marginal edge of said inner side panels, and said inner top wall portion having openings formed therein opening downwardly into the upper rear portions of said areas between said side walls and corresponding side panels, the upper marginal portion of said area between said rear wall and said rear panel opening into the area defined between said top wall upper rear portion and said inner top wall portion, said flue outlet opening including an upstanding tubular outlet fitting secured downwardly through the upper rear portion of said top wall and also downwardly through said inner top wall with a rear portion of the interior of said tubular outlet fitting disposed to the rear of the upper marginal portion of said rear inner panel and opening downwardly directly into the upper portion of the area between said rear wall and rear inner panel, the rear portion of the interior of said outlet fitting opening downwardly into said area between said rear wall and said rear inner panel serving as a venturi to admit a portion of the air supplied to the area between said rear wall and said rear wall panel by said combustion air inlet means directly into said outlet fitting for admixing with and thus cooling of the gaseous byproducts of combustion discharged into said outlet fitting from said firebox.

2. The combination of claim 1 wherein the forward portions of the upper marginal edges of said side panels extend upwardly to the forward opposite side upper marginal portions of said top wall and the rear portions of the upper marginal edges of said side panels terminate upwardly below the rear opposite side upper marginal portions of said top wall.

3. The combination of claim 2 wherein said combustion air inlet means includes adjustable damper means for varying the amount of air which may be drawn into said area between said rear wall and said rear panel.

4. The combination of claim 1 wherein said front wall includes an access opening formed therein.

5. The combination of claim 4 including door means removably closing said access opening.

6. The combination of claim 5 wherein said door means includes supplemental draft air inlet means.

7. The combination of claim 6 wherein said door means includes means for adjustably throttling said supplemental draft air inlet means.

* * * * *